US007213903B2

(12) United States Patent
Danzuka

(10) Patent No.: US 7,213,903 B2
(45) Date of Patent: May 8, 2007

(54) LIQUID-DISCHARGE-HEAD RECOVERING DEVICE

(75) Inventor: Toshimitsu Danzuka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 305 days.

(21) Appl. No.: 10/901,491

(22) Filed: Jul. 28, 2004

(65) Prior Publication Data

US 2005/0024422 A1 Feb. 3, 2005

(30) Foreign Application Priority Data

Jul. 30, 2003 (JP) ..... 2003-203982

(51) Int. Cl.
*B41J 2/165* (2006.01)

(52) U.S. Cl. ..... 347/29; 347/30; 347/32

(58) Field of Classification Search ..... 347/22–24, 347/29, 30, 31, 32, 33
See application file for complete search history.

(56) References Cited

U.S. PATENT DOCUMENTS 6,540,322 B2 * 4/2003 Usui et al. ..... 347/29

* cited by examiner

*Primary Examiner*—Shih-Wen Hsieh
(74) *Attorney, Agent, or Firm*—Canon U.S.A. Inc I.P. Div

(57) ABSTRACT

A capping unit for use with a liquid discharge head. The capping unit includes a cap for covering a discharge surface of the liquid discharge head. The cap includes air-communication openings provided at corners of the cap, and a suction opening. The air-communication openings connect a space in the cap with the atmosphere. A high negative pressure pump provides pressure to the space via the suction opening. The cap minimizes liquid spatter on the discharge surface after a suction process.

14 Claims, 9 Drawing Sheets

LIQUID-DISCHARGE-HEAD RECOVERING DEVICE

This application claims priority from Japanese Patent Application No. 2003-203982 filed Jul. 30, 2003, which is hereby incorporated by reference.

BACKGROUND OF THE INVENTION

1. Field of the Invention

The present invention relates to image recording apparatuses, and more particularly to a liquid-discharge-head recovering device.

2. Description of the Related Art

Liquid discharge heads, such as inkjet print heads, are widely used in, for example, inkjet printers and have been researched for many years. There are problems existing in conventional liquid discharge heads in that the nozzles disposed in the discharging surface cannot properly discharge liquid or that the discharging direction of the liquid may deviate from the intended direction. This can be caused when the liquid (for example, an ink solvent) in the nozzles evaporates, increasing the viscosity of the liquid in each nozzle, or when foreign matter, such as paper dust, becomes attached to the nozzles.

For these reasons, inkjet printers are generally provided with a liquid-discharge-head recovering device which includes, for example, a liquid-discharge-head cap for preventing the evaporation of the liquid (ink solvent) in the nozzles; a suction unit for sucking out and removing the thickened liquid (ink) from the nozzles; and a wiping unit for wiping off the liquid remaining on the discharging surface and any foreign matter, such as paper dust, attached to the discharging surface.

FIG. 10 is a schematic plan view of a conventional liquid-discharge-head cap 410. FIG. 11 is a cross-sectional view of a discharge head 300 and the cap 410 taken along line XI—XI in FIG. 10. Specifically, the plan view of FIG. 10 is viewed from a direction indicated by an arrow V shown in FIG. 11. Referring to FIGS. 10 and 11, the discharge head 300 is an inkjet print head having a discharging surface 301 in which nozzles are disposed. The liquid-discharge-head cap 410 is generally formed of an elastic material, such as rubber, so that the contact between the cap 410 and the discharging surface 301 can be properly maintained. Moreover, the cap 410 has a base 411.

The cap 410 is driven by a known cap-driving unit, such as a cam or a motor, and is movable in directions indicated by an arrow G in FIG. 11. Specifically, the cap 410 is capable of moving back and forth to come into and out of contact with the discharging surface 301, that is, between a capping position and a non-contact position, which is not shown in FIG. 11.

The base 411 of the cap 410 is provided with a suction opening 412, and this suction opening 412 is connected with a suction tube 420. Moreover, the suction tube 420 is connected with a suction pump 425 which functions as a pressure-reducing source. When the cap 410 is in the capping position, the suction pump 425 performs a suction process via the suction opening 412 to reduce the pressure in a space 450 formed between the cap 410 and the discharging surface 301.

Furthermore, the base 411 is provided with an air-communication opening 413, and this air-communication opening 413 is connected with an air-communication tube 430. Moreover, the air-communication tube 430 is connected with an air-communication valve 435 which functions as an air-communication controlling element. The valve 435 is for controlling whether to open or close the communication between the space 450 and the atmosphere via the air-communication opening 413. As shown in FIGS. 10 and 11, the space 450 of the cap 410 includes an absorber 440 formed of an ink-absorptive porous material.

A suction process of a typical liquid-discharge-head recovering device provided with the liquid-discharge-head cap 410 described above will now be described.

For performing the suction process, the cap 410 is first set at the non-contact position, and the discharge head 300 is moved to a position where it faces the cap 410. The cap 410 is then moved to a capping position by means of the cap-driving unit. Subsequently, the air-communication valve 435 is closed. The suction pump 425 then operates so as to reduce the pressure in the space 450.

Consequently, the ink is sucked out from the nozzles of the discharge head 300. The ink removed from the nozzles is absorbed by the ink absorber 440, but is immediately drawn into the suction pump 425. Subsequently, the air-communication valve 435 opens and connects the space 450 with the atmosphere. In most recovering devices, the suction pump 425 remains in an operative state after the air-communication valve 435 is opened so that the ink remaining in the space 450, especially the ink absorbed in the ink absorber 440, can be drawn into the suction pump 425. The cap 410 is then driven to the non-contact position, i.e. an unsealing position, by means of the cap-driving unit. The suction pump 425 is drained by an ink drainage process such that the ink drawn into the suction pump 425 is emitted out of the recovering device in a direction indicated by an arrow W in FIG. 11.

In most cases, after performing such a suction process, some of the ink sucked out from the nozzles remains on the discharging surface 301. This may be problematic if the ink remaining on the discharging surface 301 covers the nozzles since it may lead to improper discharging of liquid or deviation of the discharging direction of liquid, as described previously. To prevent such problems, most inkjet printers are provided with a wiping unit for wiping off the ink remaining on the discharging surface 301 after the suction process. This effectively prevents the problems described above, such as the improper discharging of liquid and the deviation of the discharging direction of liquid.

In recent years, small-sized inkjet printers have been widely manufactured. Such small-size inkjet printers are mainly used for printing images taken by, for example, digital cameras, on relatively small-size paper, such as A6-size paper. For reducing the size of such printers, the ink capacity of the printer must be relatively reduced as much as possible. For this reason, the amount of ink to be sucked out from the nozzles during the suction process must also be reduced to the greatest extent possible.

To fulfill such demands, a negative-pressure valve may be disposed in a section of the suction tube 420 between the suction opening 412 and the suction pump 425. This negative-pressure valve is an on-off valve that allows the pressure in the space 450 to be reduced by means of the suction pump 425. In detail, in a state where the negative-pressure valve is closed, the suction pump 425 begins its operation so as to reduce the pressure in a space in the suction tube 420 between the negative-pressure valve and the suction pump 425. Thus, the pressure in this space in the suction tube 420 is highly reduced with respect to the ambient pressure. This highly-reduced pressure will be referred to as high negative pressure hereinafter. Subsequently, when the high negative pressure reaches a predetermined value and the negative-pressure valve opens, the pressure in the space 450 in the cap 410 is reduced at once. Shortly after the negative-pressure valve is opened, the air-communication valve 435 is opened. This suction process, which utilizes high negative pressure, is effective due to the fact that the pressure in the space 450 is greatly reduced in an extremely short period of time. Specifically, this reduces the amount of ink sucked out from the nozzles, and moreover, effectively removes, for example, thickened ink attached around each nozzle and bubbles formed inside the nozzles.

However, when performing the suction process using high negative pressure in the conventional liquid-discharge-head recovering devices, the amount of ink remaining on the discharging surface 301 may increase due to the following reasons. Because the air-communication valve 435 opens shortly after the negative-pressure valve is opened, an extremely high negative pressure still remains in the space 450 just before the air-communication valve 435 is opened. For this reason, when the air-communication valve 435 opens, atmospheric gas enters the space 450 at an extremely high rate through the air-communication opening 413. The ink present in the space 450 when the air-communication valve 435 is opened, that is, the ink previously sucked out from the nozzles when the negative-pressure valve opened, spatters in various directions in the space 450 due to the fast-flowing gas.

In a case where a large amount of ink is present in the vicinity of the air-communication opening 413, the amount of ink spattering is relatively large and may even reach the contact section between the discharging surface 301 and the cap 410. Thus, even if the suction pump 425 continues to operate in this state, the suction pump 425 may be able to suck in the ink absorbed in the ink absorber 440 but not the ink present in other regions within the space 450 of the cap 410. For this reason, the ink attached to the discharging surface 301 may remain even after the cap 410 is moved to the non-contact position. Of all the ink remaining in the contact section between the discharging surface 301 and the cap 410, the amount of ink remaining in the contact section near the air-communication opening 413 is especially large.

Accordingly, for performing the suction process using high negative pressure in the conventional recovering devices, the amount of ink remaining on the discharging surface 301 is large in comparison with performing the suction process without using the high negative pressure. The larger amount of ink left on the discharging surface 301 may be problematic for the subsequent wiping process, which is generally performed after the suction process, in that the ink may spatter to various parts of the inkjet printer during the wiping process, and moreover, that the ink may attach to, for example, a wiper blade used for the wiping process and may thicken when the wiper blade is left unused.

SUMMARY OF THE INVENTION

The present invention is directed to a capping unit for use with a liquid-discharge-head that minimizes liquid spatter during a suction process so that after the suction process, liquid spatter during a wiping process is minimized and thickening of the liquid remaining on a wiper blade used during a wiping process is prevented. The present invention is also directed to a recovering device incorporating the capping unit and directed to an image forming apparatus incorporating the recovering device.

In one aspect of the present invention, the capping unit includes a cap having a periphery, the cap defining a cavity with the liquid discharge head, a suction opening defined in the cap, and an air-communication opening defined at about the periphery of the cap, the air-communication opening connecting the cavity with an atmosphere. In another aspect of the present invention, a recovering device includes a wiping unit operable to wipe the discharge surface, and a cap selectively moving into and out of contact with the discharge surface, the cap including a base having a corner, a space defined by the base and the discharge surface, a suction opening defined in the base and communicating with the space, an air-communication opening defined at about the corner, the air-communication opening communicating with the space.

Further features and advantages of the present invention will become apparent from the following description of the embodiments (with reference to the attached drawings).

DESCRIPTION OF THE EMBODIMENTS

Figure 1:
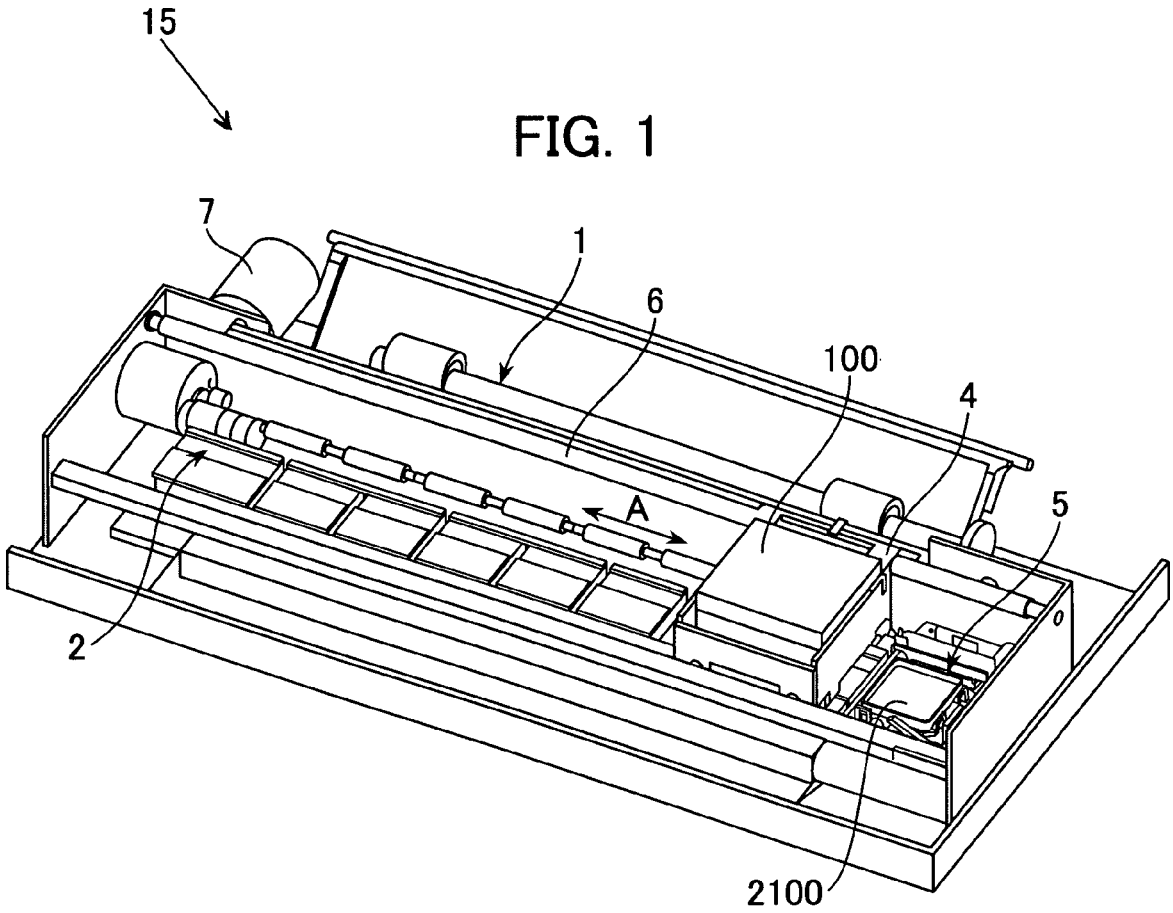
FIG. 1 is a schematic perspective view of an inkjet printer which includes a liquid-discharge-head recovering device provided with a liquid-discharge-head cap according to one of embodiments of the present invention.

Embodiments of the present invention will now be described with reference to the drawings. In the drawings, the same reference numerals are used to indicate the same components or to indicate corresponding components having similar functions.

Figure 2:
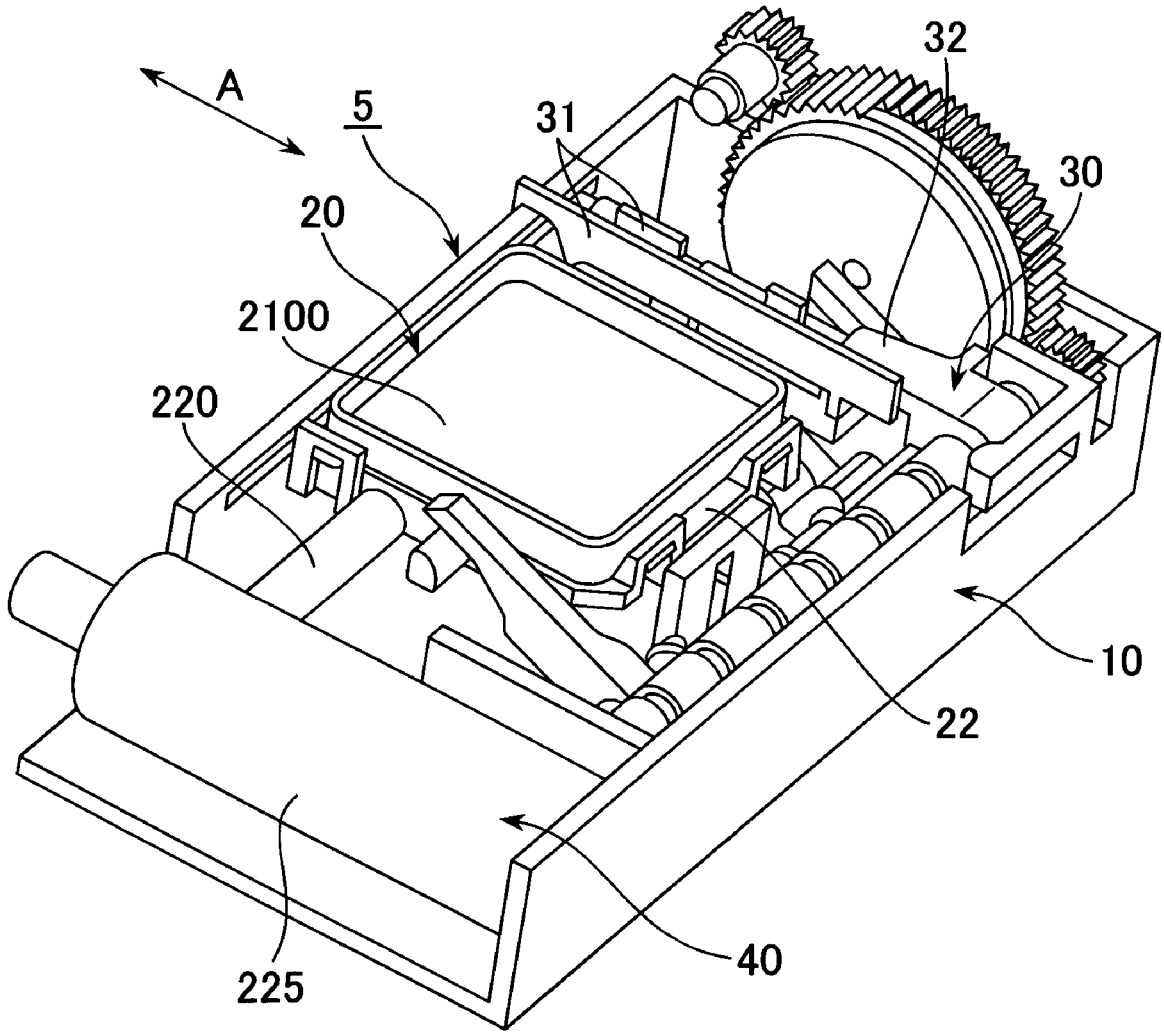
FIG. 2 is a schematic perspective view of the recovering device in FIG. 1.
Figure 3:
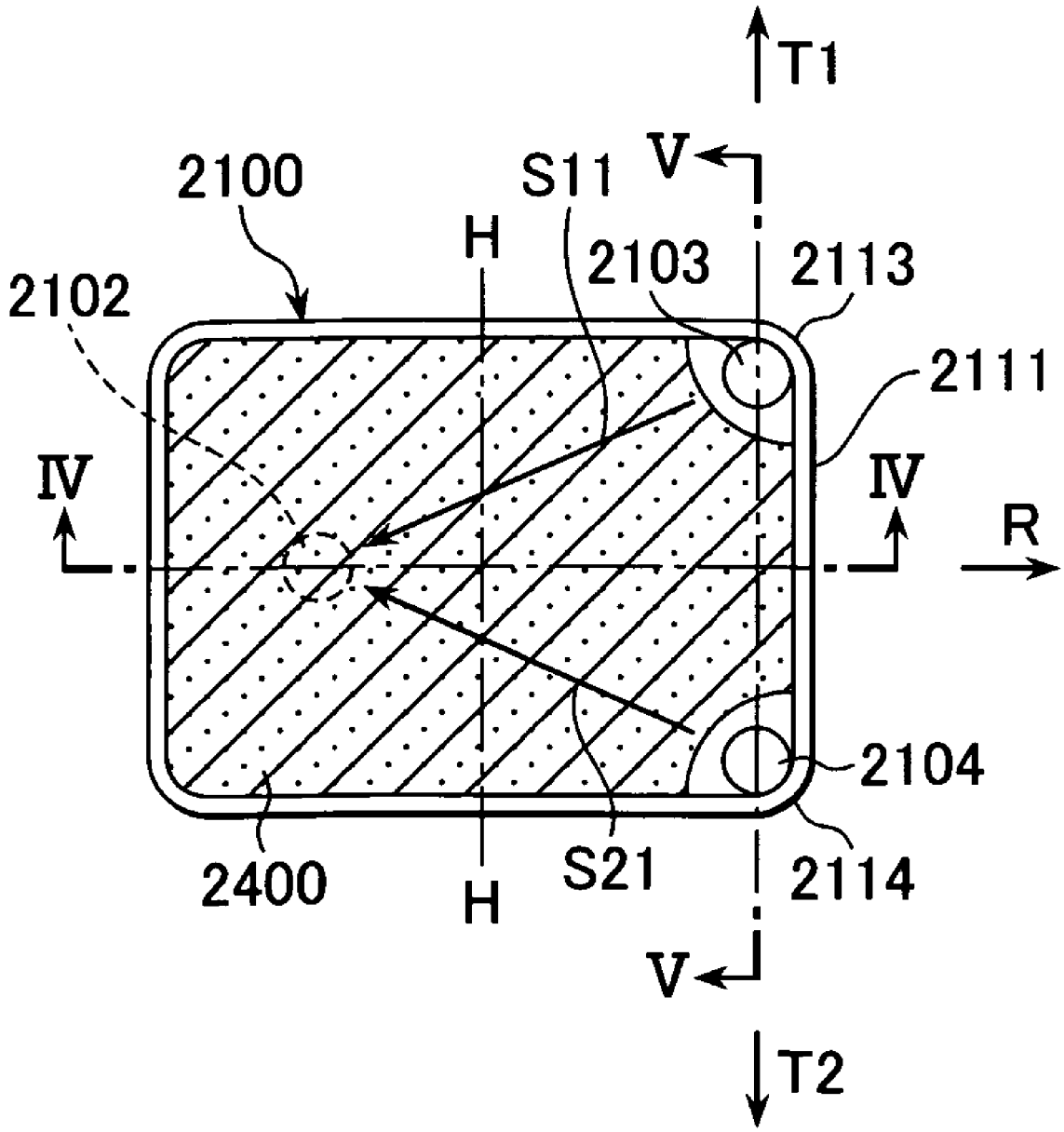
FIG. 3 is a schematic plan view of the cap according to a first embodiment of the present invention.
Figure 4:
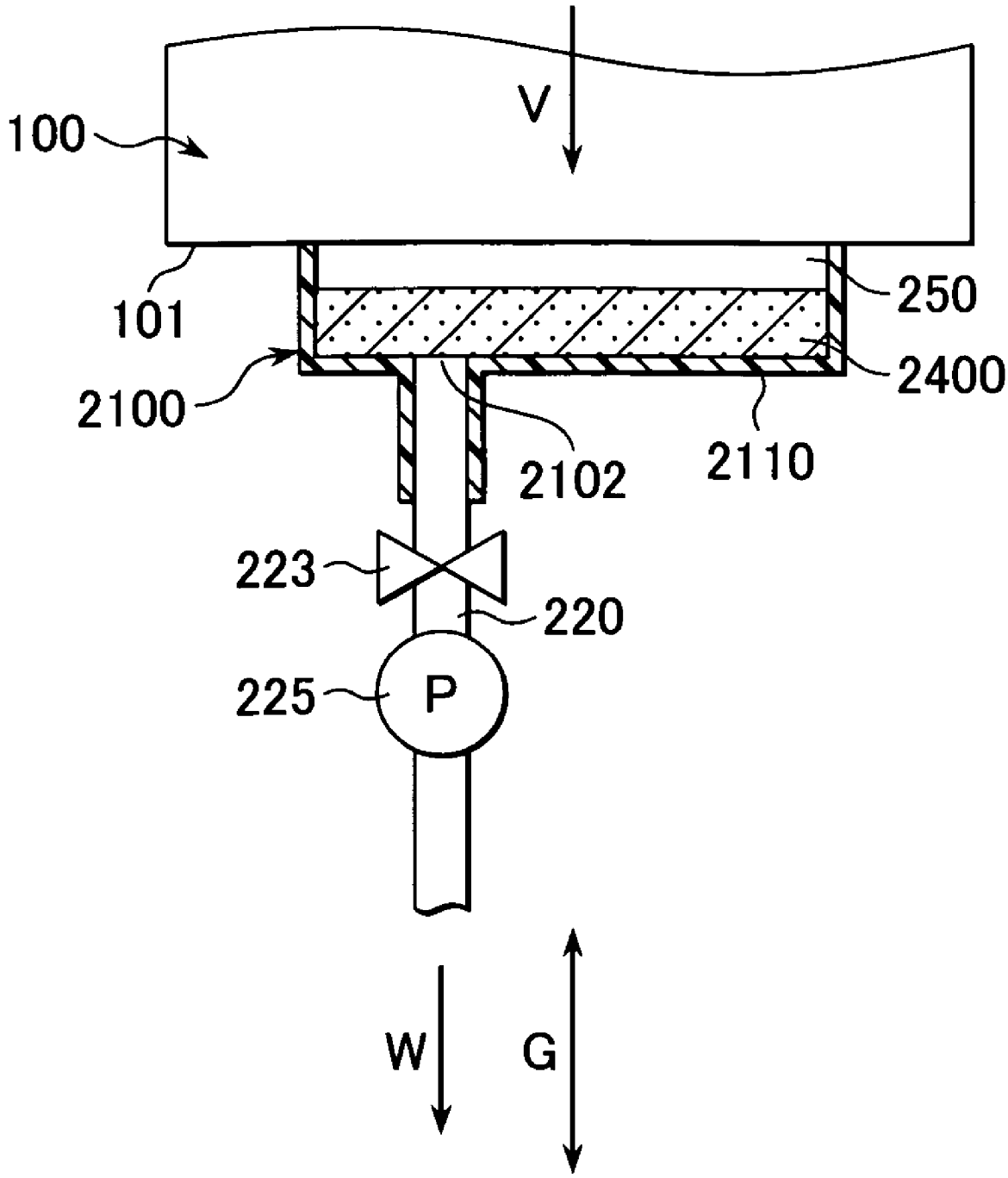
FIG. 4 is a cross-sectional view of the recovering device including the cap taken along line IV—IV in FIG. 3.
Figure 5:
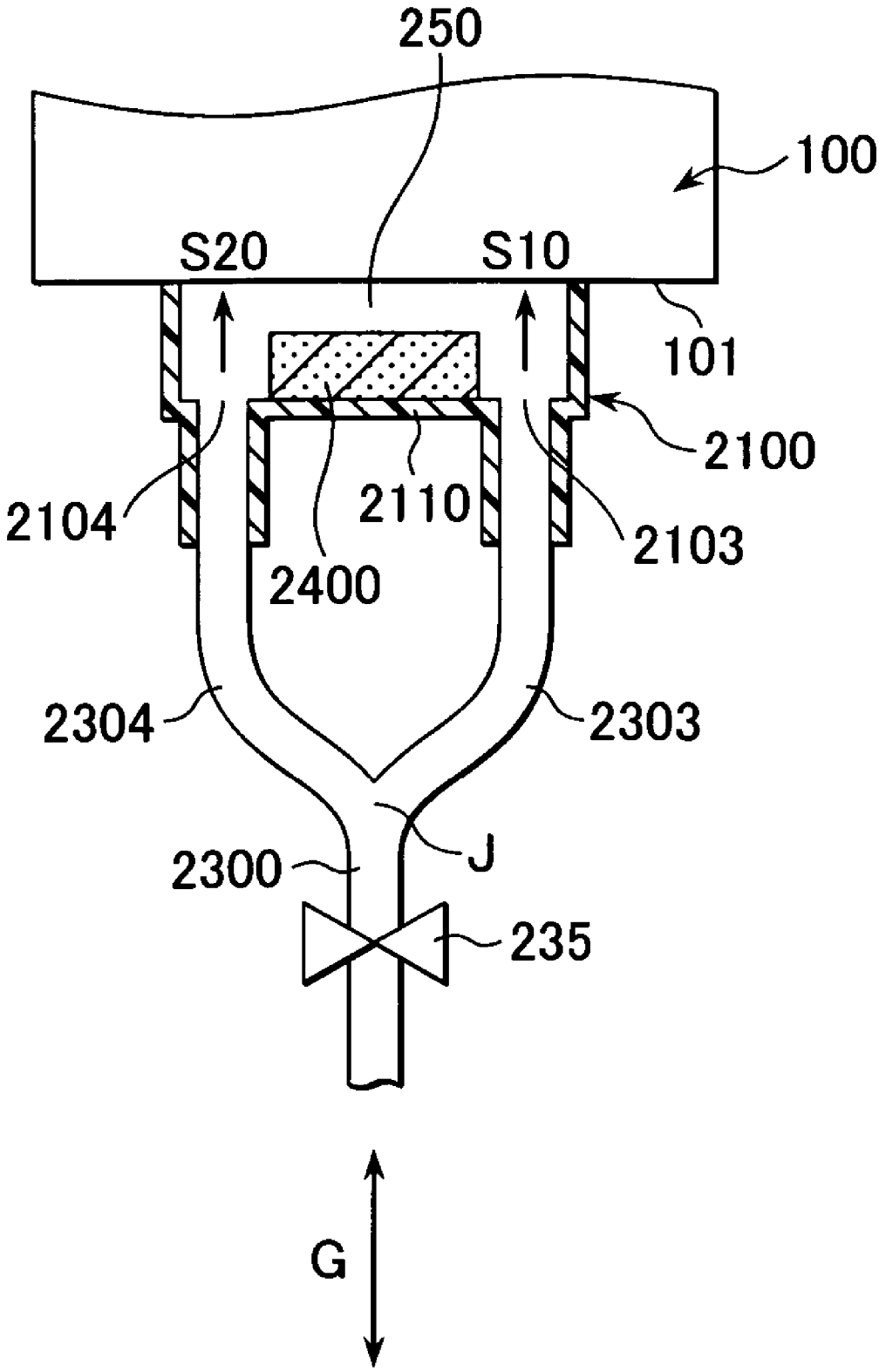
FIG. 5 is a cross-sectional view of the recovering device including the cap taken along line V—V in FIG. 3.

FIG. 1 is a schematic perspective view of an inkjet printer 15 which includes a liquid-discharge-head recovering device 5 provided with a liquid-discharge-head cap 2100 according to one of the embodiments of the present invention. FIG. 2 is a schematic perspective view of the recovering device 5 in FIG. 1. FIG. 3 is a schematic plan view of the cap 2100 according to a first embodiment of the present invention. FIG. 4 is a cross-sectional view of the recovering device 5 including the cap 2100 taken along line IV—IV in FIG. 3. FIG. 5 is a cross-sectional view of the recovering device 5 including the cap 2100 taken along line V—V in FIG. 3.

The inkjet printer 15 in FIG. 1 is provided with a feeder 1 for feeding a recording medium, such as paper, to a recording position; a sender 2 for pulling the recording medium from the feeder 1; a liquid discharge head (an inkjet print head) 100 functioning as a printing element; a carriage 4 which carries the discharge head 100 and moves horizontally with respect to the recording medium for scanning; the recovering device 5 for recovering the liquid discharging performance of the discharge head 100; a guide shaft 6 for guiding the carriage 4 such that the carriage 4 is capable of oscillating along the guide shaft 6; and a carriage motor 7 functioning as a driving source for the carriage 4 such that the carriage 4 is movable in two directions indicated by an arrow A in FIG. 1.

Referring to FIGS. 2 to 5, the recovering device 5 functions as a recovering element and includes a capping unit 20. The capping unit 20 includes the cap 2100 for covering a discharging surface 101 of the discharge head 100 when the inkjet printer 15 is in a non-recording state. The recovering device 5 also includes a wiping unit 30 for wiping the discharging surface 101, and a suction unit 40 for drawing in liquid from nozzles disposed on the discharging surface 101 when the discharging surface 101 is being covered with the capping unit 20. The units 20, 30, and 40 are disposed on a base 10 of the recovering device 5.

The discharge head 100 of the present invention performs the printing operation in the following manner. First, an electric-heat transferring element (not shown) in the discharge head 100 applies heat energy to ink contained in the discharge head 100. The heat vaporizes the ink to create a bubble. The bubble expands and shrinks to generate a pressure change. This pressure change induces discharge of ink from each of the nozzles for performing printing.

Referring to FIGS. 1 and 2, the arrow A indicates the moving direction of the carriage 4 carrying the discharge head 100. The cap 2100 is preferably formed of an elastic material, such as rubber or elastomer, and is for hermetically sealing the discharging surface 101 of the discharge head 100. Moreover, the cap 2100 is mounted on a cap holder 22 having a rigid body. When a printing operation is not being performed or when a suction process for recovering the discharging performance of the discharge head 100 is being performed, the cap 2100 is moved to a position where it comes into contact with the discharging surface 101 by means of a cap-driving unit.

Referring to FIG. 2, the wiping unit 30 is for wiping the discharging surface 101 of the discharge head 100 to remove liquid, i.e. ink, or foreign matter, such as paper dust, attached to the discharging surface 101. The wiping unit 30 is provided with a wiper holder 32 for holding a wiper 31, which can be rubbed against the discharging surface 101. Thus, the wiping unit 30 is capable of performing the wiping process by moving the wiper holder 32 in the rubbing direction and also by moving the wiper holder 32 toward and away from the discharging surface 101.

Referring to FIG. 2, the suction unit 40 includes a suction pump 225 and a suction tube 220. The suction pump 225 is connected to the cap 2100 via the suction tube 220.

As described above, FIG. 3 is a schematic plan view of the cap 2100 according to the first embodiment. FIG. 4 is a cross-sectional view of the recovering device 5 including the cap 2100 taken along line IV—IV in FIG. 3, and FIG. 5 is a cross-sectional view of the recovering device 5 including the cap 2100 taken along line V—V in FIG. 3. The cap 2100 is formed of an elastic material, such as rubber, and has a substantially rectangular base 2110 whose four corners are curved.

When the cap 2100 faces the discharging surface 101 of the discharge head 100, the cap 2100 is capable of moving towards and away from the discharging surface 101 for sealing and unsealing the discharging surface 101, respectively. Here, the cap 2100 is driven by means of a cap-driving unit, which is not shown in the drawings. FIGS. 4 and 5 illustrate a state in which the cap 2100 is in contact with the discharging surface 101, that is, a sealed state. In this sealed state, a space/cavity 250 is formed between the cap 2100 and the discharging surface 101.

Referring to FIGS. 3 and 5, the base 2110 of the cap 2100 is provided with air-communication openings 2103 and 2104. The air-communication openings 2103 and 2104 are disposed at about a periphery of the cap 2100, such as at corners 2113 and 2114. Specifically, the two opposite ends of one of the shorter sides 2111 of the substantially rectangular base 2110 respectively have the two neighboring corners 2113 and 2114, and the openings 2103 and 2104 are disposed adjacent to the corners 2113 and 2114, respectively. Furthermore, the openings 2103 and 2104 are connected to air-communication tubes 2303 and 2304, respectively. As shown in FIG. 5, the tubes 2303 and 2304 are joined together at position J to become a single air-communication tube 2300.

The tube 2300 is connected with an air-communication valve 235, which functions as a controlling element for controlling the communication between the space 250 and the atmosphere via the openings 2103 and 2104.

An imaginary line H—H in FIG. 3 extends substantially through the center of the base 2110 of the cap 2100 and substantially bisects the base 2110. In detail, the imaginary line H—H is parallel to an imaginary line extending between the openings 2103 and 2104, namely, line V—V in FIG. 3. The base 2110 is provided with a suction opening 2102 in one of the two imaginary-bisected regions not having the air-communication openings 2103 and 2104. The suction opening 2102 is connected to the suction tube 220.

Referring to FIG. 4, the suction tube 220 is connected to a negative-pressure valve 223 and the suction pump 225. The negative-pressure valve 223 is an on-off valve that allows the pressure in the space 250 in the cap 2100 to be reduced by means of the suction pump 225. The suction pump 225 is, for example, a piston pump. In other words, the cap 2100 is connected with the suction pump 225 included in the suction unit 40 via the suction opening 2102, and the suction pump 225 functions as a pressure-reducing source for the suction of the space 250. Furthermore, the interior of the cap 2100 defined by the space 250 is provided with a liquid absorber 2400, such as an ink absorber, formed of a liquid-absorptive porous material. In the first embodiment, the liquid absorber 2400 is disposed over the suction opening 2102 but not over the air-communication openings 2103 and 2104.

Referring to FIGS. 3 to 5, the suction process performed by the recovering device 5 provided with the cap 2100 will now be described. Firstly, the discharge head 100, i.e. the inkjet print head, is moved to a position where the discharge head 100 faces the cap 2100. Secondly, the cap 2100 is moved to the capping position so that the cap 2100 comes into contact with the discharging surface 101 by means of the cap-driving unit. Then, the negative-pressure valve 223 and the air-communication valve 235 are closed. As described previously, the negative-pressure valve 223 is an on-off valve that controls the communication between the suction pump 225 and the space 250. On the other hand, the air-communication valve 235 is also an on-off valve that controls the communication between the space 250 and the atmosphere.

The suction pump 225 then begins the suction operation and reduces the pressure in a space in the suction tube 220 between the negative-pressure valve 223 and the suction pump 225. The negative-pressure valve 223 is opened as soon as the pressure in the space is reduced to a predetermined level so that the pressure in the space 250 in the cap 2100 can be reduced at once. Consequently, this high negative pressure sucks out the ink from the nozzles of the discharge head 100. Even though the ink may spatter in the space 250 including the liquid absorber 2400, the odds of the ink spatter reaching the vicinity of the four corners of the substantially rectangular base 2110 are low, and in most cases, the ink does not reach the vicinity of the four corners.

Subsequently, the air-communication valve 235 opens shortly after the negative-pressure valve 223 is opened. Since there is still an extremely high negative pressure in the space 250 as the air-communication valve 235 is being opened, atmospheric gas enters the space 250 at an extremely high rate through the air-communication openings 2103 and 2104.

Although this fast-traveling gas flows toward the discharging surface 101 in a direction indicated by arrows S10 and S20 in FIG. 5, the gas cannot flow in a direction indicated by an arrow R in FIG. 3 since the air-communication openings 2103 and 2104 are disposed adjacent to the respective neighboring corners 2113 and 2114. Furthermore, because the gas flows into the space 250 from both the openings 2103 and 2104, only a small amount of gas flows in directions indicated by arrows T1 and T2 in FIG. 3. Moreover, as indicated by arrows S11 and S21 in FIG. 3, according to the suction effect by the suction pump 225 via the suction opening 2102, the gas flows substantially parallel to the discharging surface 101 towards the suction opening 2102 so as to be drawn into the suction pump 225.

Although the atmospheric gas traveling at a high rate may further cause the ink to spatter in the space 250, because the air-communication openings 2103 and 2104 are respectively disposed adjacent to the neighboring corners 2113 and 2114, the amount of ink remaining on the discharging surface 101 after the completion of the suction process can be reduced due to the following three reasons.

The first reason is that there is only a small amount of ink present in the vicinity of the air-communication openings 2103 and 2104 when the air-communication valve 235 is opened.

The second reason is that the gas entering the space 250 when the air-communication valve 235 opens does not flow in the direction indicated by the arrow R in FIG. 3, and moreover, only a small amount of gas flows in directions indicated by the arrows T1 and T2 in FIG. 3. This implies that there is only an extremely small amount of ink left in a contact section between the discharging surface 101 and the cap 2100 adjacent to the openings 2103 and 2104.

The third reason is that the gas entering the space 250 when the air-communication valve 235 opens flows substantially parallel to the discharging surface 101 towards the suction opening 2102 at an extremely high rate, as indicated by the arrows S11 and S21 in FIG. 3. This implies that, when the valve 235 is opened, most of the ink spattered in the space 250 is directed towards the suction opening 2102 and is carried with the fast-traveling gas flowing substantially parallel to the discharging surface 101 without being left on the discharging surface 101. Thus, the ink is drawn into the suction pump 225 with the gas through the suction opening 2102.

According to the three reasons described above, the ink remaining on the discharging surface 101 after the suction process can be reduced to a small amount. In a case where a piston pump is used for the suction pump 225, the piston of the suction pump 225 moves continuously as the suction process is started for pressure reduction, and continues to move after the air-communication valve 235 is opened. Thus, the ink absorbed by the liquid absorber 2400 in the space 250 is effectively drawn into the suction pump 225, i.e. the piston pump. Finally, the cap-driving unit drives the cap 2100 to an unsealing position, i.e. the non-contact position. Furthermore, the suction pump 225, i.e. the piston pump, is drained by a known ink drainage process such that the ink drawn into the suction pump 225 is emitted out of the recovering device 5.

Due to the cap 2100 and the recovering device 5 provided with the cap 2100, the liquid (ink) remaining on the discharging surface 101 after the suction process can be reduced to a small amount. Moreover, the recovering device 5 of the present invention can prevent the problems occurring in the previously-described conventional recovering device. To achieve an effective suction process using high negative pressure, the pressure in the space 250 after opening the negative-pressure valve 223 is reduced by about 30 kPa or more, and moreover, the pressure in the space 250 after opening the air-communication valve 235 is reduced by about half the amount of the reduced pressure after opening the negative-pressure valve 223, that is, about 15 kPa or more. Furthermore, the pressure in the space 250 after opening the negative-pressure valve 223 can be reduced to about 50 kPa or more, and to reduce the pressure in the space 250 after opening the air-communication valve 235 by about 70% of the amount of the reduced pressure after opening the negative-pressure valve 223, that is, about 35 kPA or more.

Furthermore, according to the first embodiment described above, the pressure level in the space 250 after opening the negative-pressure valve 223 and the pressure level in the space 250 after opening the air-communication valve 235 may respectively be controlled by adjusting, for example, the time period between the starting point of the suction by the suction pump 225 and the opening point of the negative-pressure valve 223, and between the opening point of the negative-pressure valve 223 and the opening point of the air-communication valve 235.

According to the first embodiment, a liquid-discharge-head cap and a liquid-discharge-head recovering device that prevents problems occurring in a wiping process, which is generally performed after a suction process, are provided. Specifically, the liquid-discharge-head cap 2100 and the liquid-discharge-head recovering device 5 of the first embodiment perform an effective suction process that can reduce the liquid remaining on the discharging surface 101 of the discharge head 100 after the suction to a small amount. Accordingly, this prevents problems occurring in a wiping process caused by spattering of liquid remaining on the discharging surface 101 and also by thickening of liquid remaining on, for example, a wiper blade used for the wiping process caused when the wiper blade is left unused.

Figure 6:
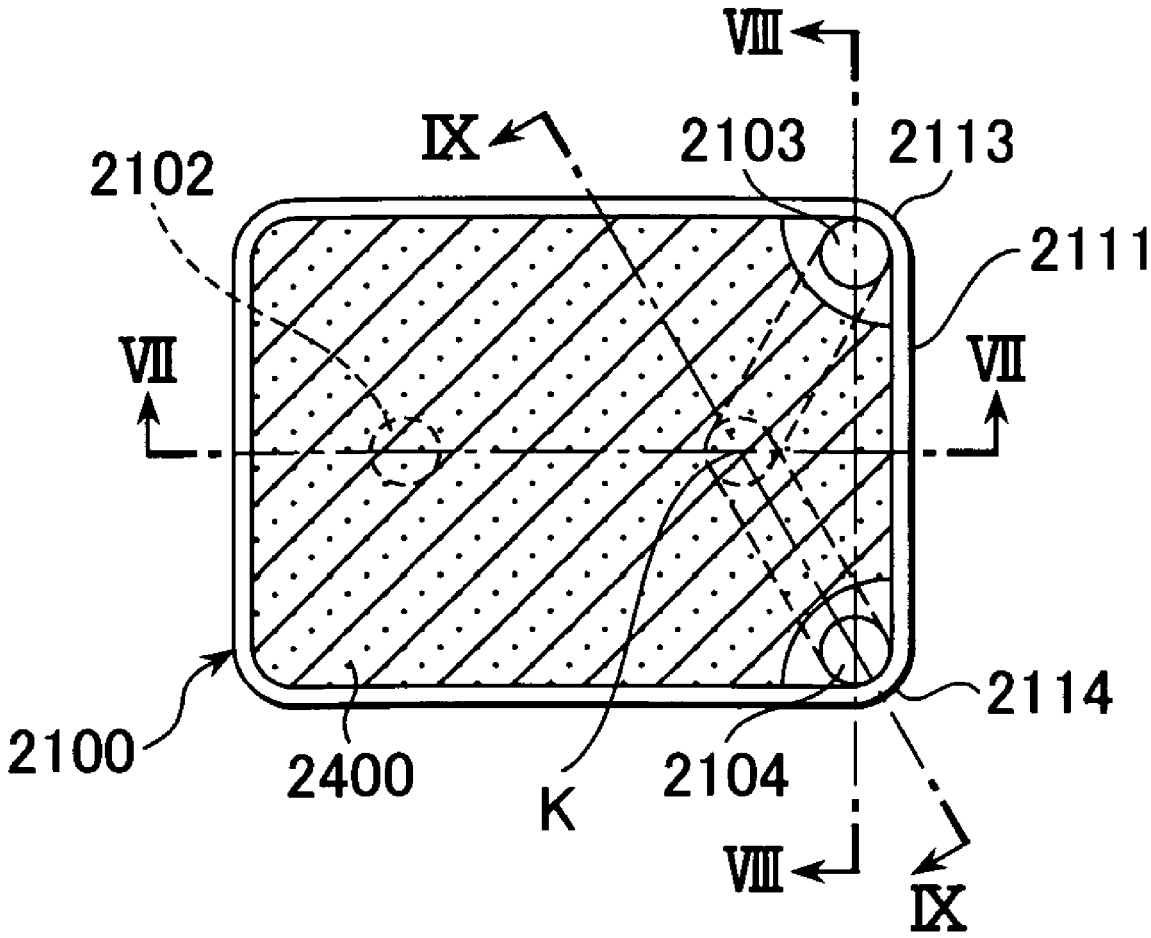
FIG. 6 is a schematic plan view of the liquid-discharge-head cap according to a second embodiment of the present invention.
Figure 7:
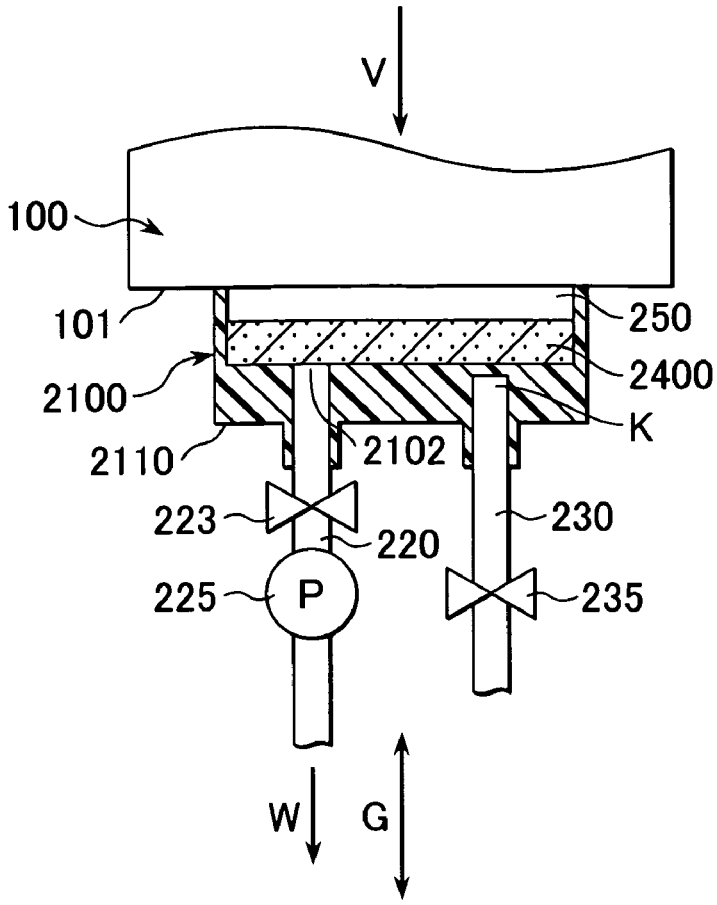
FIG. 7 is a cross-sectional view of the recovering device including the cap taken along line VII—VII in FIG. 6.
Figure 8:
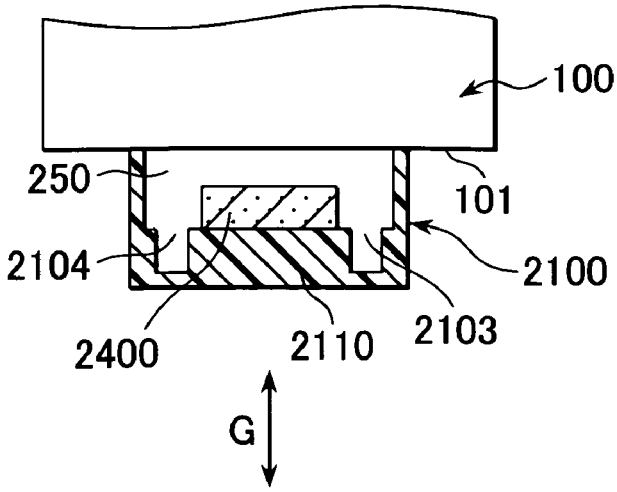
FIG. 8 is a cross-sectional view of the recovering device including the cap taken along line VIII—VIII in FIG. 6.
Figure 9:
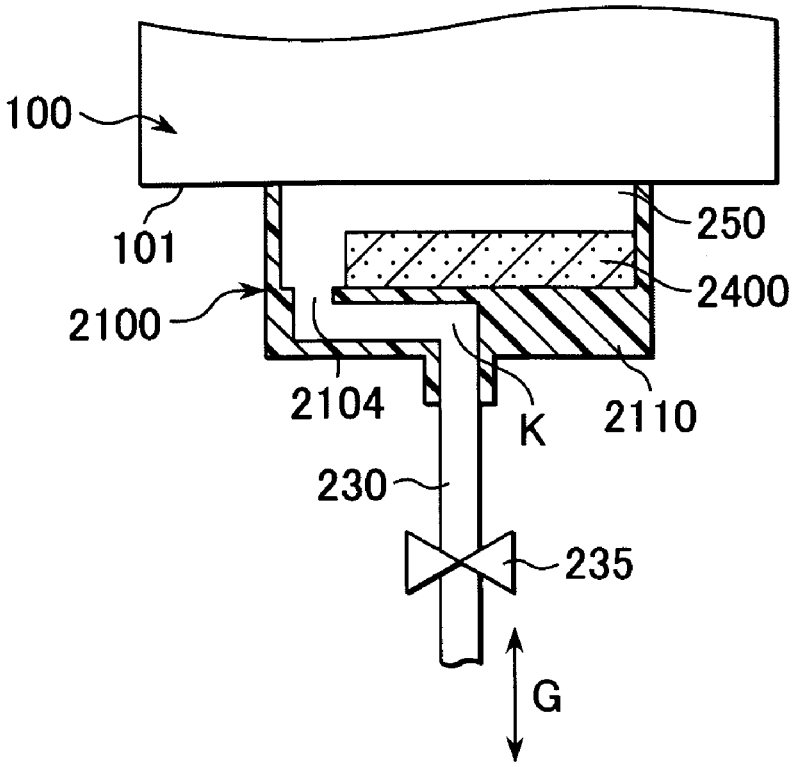
FIG. 9 is a cross-sectional view of the recovering device including the cap taken along line IX—IX in FIG. 6.
Figure 10:
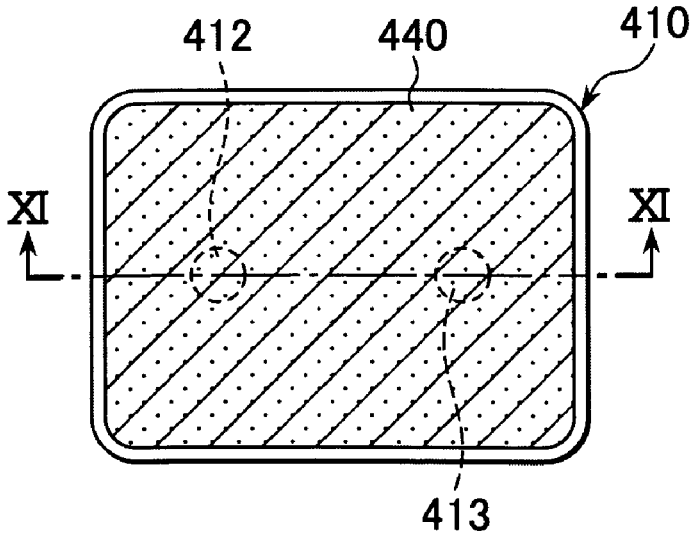
FIG. 10 (PRIOR ART)
FIG. 10 is a schematic plan view of a typical liquid-discharge-head cap.
Figure 11:
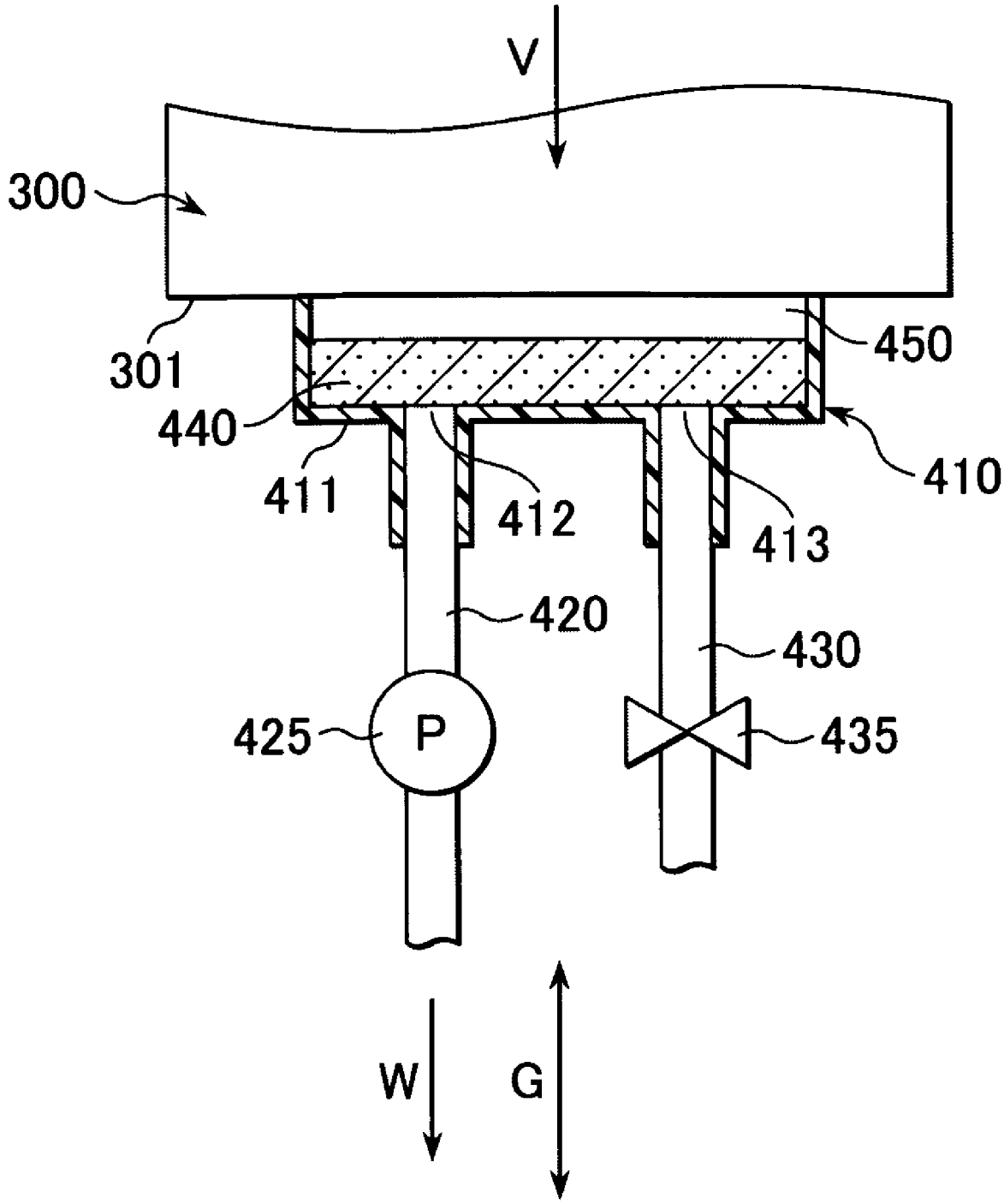
FIG. 11 (PRIOR ART)
FIG. 11 is a cross-sectional view of a typical liquid-discharge-head recovering device including the cap of FIG. 10 taken along line XI—XI of FIG. 10.

FIG. 6 is a schematic plan view of the liquid-discharge-head cap 2100 according to a second embodiment of the present invention. FIG. 7 is a cross-sectional view of the recovering device 5 including the cap 2100 taken along line VII—VII in FIG. 6. FIG. 8 is a cross-sectional view of the recovering device 5 including the cap 2100 taken along line VIII—VIII in FIG. 6. FIG. 9 is a cross-sectional view of the recovering device 5 including the cap 2100 taken along line IX—IX in FIG. 6.

Referring to FIGS. 6 to 9, similar to the first embodiment, the cap 2100 of the second embodiment is formed of an elastic material, such as rubber, and has the substantially rectangular base 2110 whose four corners are curved. The base 2110 is provided with the air-communication openings 2103 and 2104. Like the first embodiment, the two opposite ends of one of the shorter sides 2111 of the substantially rectangular base 2110 respectively have neighboring corners 2113 and 2114, and the openings 2103 and 2104 are disposed adjacent to the corners 2113 and 2114, respectively. In the second embodiment, the openings 2103 and 2104 are joined together at position K in the base 2110, and this joint section is connected to an air-communication tube 230. Furthermore, the air-communication tube 230 is connected to the air-communication valve 235, which functions as a controlling element for controlling the communication between the space 250 and the atmosphere via the openings 2103 and 2104.

The base 2110 is provided with the suction opening 2102 in the same position as the first embodiment, and the suction opening 2102 is connected to the suction tube 220. The suction tube 220 is connected to the negative-pressure valve 223 and the suction pump 225. The suction pump 225, which is included in the suction unit 40, functions as a pressure-reducing source for the suction of the space 250 via the suction opening 2102. Furthermore, the interior of the cap 2100 defined by the space 250 is provided with the liquid absorber 2400 formed of a liquid-absorptive (ink-absorptive) porous material. Similar to the first embodiment, the liquid absorber 2400 is disposed over the suction opening 2102 but not over the air-communication openings 2103 and 2104.

The cap 2100 and the recovering device 5 of the second embodiment shown in FIGS. 6 to 9 perform a similar suction process to that of the first embodiment. Consequently, the ink remaining on the discharging surface 101 after the suction process can be reduced to a small amount. Similar to the advantages of the first embodiment, the cap 2100 and the recovering device 5 of the second embodiment prevents problems occurring in a wiping process, which is generally performed after the suction process. As described previously, the liquid remaining on the discharging surface 101 of the discharge head 100 after the suction can be reduced to a small amount, preventing spattering of liquid during the wiping process and also preventing thickening of liquid remaining on, for example, a wiper blade used for the wiping process caused when the wiper blade is left unused.

On the other hand, in comparison with the first embodiment, the cap 2100 of the second embodiment contributes to the size reduction of the recovering device 5. Specifically, the length of the cap 2100 in the direction indicated by the arrow R in FIG. 3, and the width of the cap 2100 in the direction indicated by the arrows T1 and T2 in FIG. 3 can both be reduced while still achieving a lesser amount of ink remaining on the discharging surface 101 after the suction process. Accordingly, this is advantageous for small-size inkjet printers used mainly for printing on relatively small-size paper, such as A6-size paper.

Alternatively, the substantially rectangular base 2110 of the cap 2100 may be longer in the longitudinal direction of the drawings so that, instead of being disposed adjacent to the corners at the two respective ends of one of the shorter sides, the air-communication openings 2103 and 2104 may respectively be disposed adjacent to the corners at the two respective ends of one of the longer sides. Such a structure is included within the scope of the present invention. However, in a case where there is a significant difference in length between the longer sides and the shorter sides of the substantially rectangular base 2110 of the cap 2100, if the openings 2103 and 2104 are disposed in such a manner described above, the atmospheric gas entering the space 250 through the openings 2103 and 2104 may flow in the directions indicated by the arrows T1 and T2 in FIG. 3 and create turbulence. This can cause the ink in the space 250 to become attached to the discharging surface 101. For this reason, in a case where there is a significant difference in length between the longer sides and the shorter sides of the substantially rectangular base 2110 of the cap 2100, the openings 2103 and 2104 are disposed adjacent to the corners at the two respective ends of one of the shorter sides.

Furthermore, although the air-communication openings 2103 and 2104 are provided in the base 2110 of the cap 2100 in the above embodiments, the openings 2103 and 2104 do not necessarily have to be disposed in the base 2110. Alternatively, the openings 2103 and 2104 may be disposed in the corresponding sides of the cap 2100. Similarly, the suction opening 2102 does not necessarily have to be provided in the base 2110 of the cap 2100, and may alternatively be disposed in one of the corresponding sides of the cap 2100. Accordingly, such alternative structures related to the position of the air-communication openings 2103 and 2104 and the suction opening 2102 are included within the scope of the present invention.

Furthermore, although the suction opening 2102 is disposed in one of the two imaginary-bisected regions not having the air-communication openings 2103 and 2104 in the above embodiments, the suction opening 2102 may alternatively be disposed in the other imaginary-bisected region that has the air-communication openings 2103 and 2104. Such a structure is included within the scope of the present invention. However, disposing the suction opening in the other imaginary-bisected region may lower the effectiveness of the present invention to some extent since the suction opening 2102 is near one of the sides whose two opposite ends, i.e. the two neighboring corners, respectively have the air-communication openings 2103 and 2104 adjacent thereto.

Furthermore, although only a single suction opening 2102 is provided in the above embodiments, a plurality of suction openings 2102 may alternatively be provided. In such a case, a plurality of suction pumps 225 may be provided for the corresponding suction openings 2102 for reducing the pressure in the space 250, or a single suction pump 225 may be connected to the suction openings 2102 for reducing the pressure in the space 250.

Furthermore, although a single air-communication valve 235 is provided in the above embodiments, a plurality of air-communication valves 235 may alternatively be provided such that, for example, the air-communication tubes 2303 and 2304 shown in FIG. 5 are each provided with a corresponding air-communication valve 235.

Furthermore, although the liquid absorber 2400 provided in the space 250 is not disposed over the air-communication openings 2103 and 2104 in the above embodiments, substantially the same effect can be achieved by alternatively disposing the liquid absorber 2400 over the air-communication openings 2103 and 2104. Furthermore, the liquid absorber 2400 may alternatively cover about half the opening area of each of the air-communication openings 2103 and 2104. Accordingly, such alternative structures are included within the scope of the present invention.

However, if the liquid absorber 2400 in the space 250 is formed of a material having low porosity, the liquid absorber 2400 should not completely cover the air-communication openings 2103 and 2104 since the rate at which the atmospheric gas enters the space 250 may diminish.

Furthermore, although high negative pressure is used for performing the suction process in the above embodiments and the application of such high negative pressure exhibits the distinguishable advantage of the present invention, a similar effect can be obtained without using the high negative pressure. Accordingly, the present invention does not necessarily depend upon the magnitude of pressure used.

According to the embodiments of the present invention, a liquid-discharge-head cap that is capable of preventing problems occurring in a wiping process, which is generally performed after a suction process, is provided. Specifically, the liquid remaining on the discharging surface after the suction process can be reduced to a small amount so as to prevent spattering of liquid during the wiping process, and also to prevent thickening of liquid remaining on, for example, a wiper blade used for the wiping process caused when the wiper blade is left unused.

While the present invention has been described with reference to what are presently considered to be the embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A cap for covering nozzles of a liquid discharge head, the cap comprising:

a substantially rectangular base; and air-communication openings defined at about two neighboring corners of the substantially rectangular base, the air-communication openings connecting a space in the cap with an atmosphere.

2. The cap according to claim 1, wherein the air-communication openings are disposed in the base.

3. The cap according to claim 1, further comprising a suction opening through which pressure in the space in the cap is reduced.

4. The cap according to claim 3, wherein the suction opening is disposed in the base.

5. The cap according to claim 4, wherein, if the base is bisected with a line extending through the center of the base and parallel to a line connecting the air-communication openings so as to define a first half section and a second half section of the base, the suction opening is disposed in the first half section and the air-communication openings are disposed in the second half section.

6. A recovering device comprising:

a cap configured to cover nozzles of a liquid discharge head;

a substantially rectangular base air-communication openings defined at about two neighboring corners of the substantially rectangular base, the air-communication openings connecting a space in the cap with an atmosphere; and a wiping unit operable to wipe the nozzles of the liquid discharge head.

7. The recovering device according to claim 6, wherein the air-communication openings are disposed in the base.

8. The recovering device according to claim 6, further comprising a controlling element controlling communication between the space in the cap with the atmosphere via the air-communication openings.

9. The recovering device according to claim 6, further comprising a suction opening through which the pressure in the space in the cap is reduced.

10. The recovering device according to claim 9, wherein the suction opening is disposed in the base.

11. The recovering device according to claim 10, wherein, if the base is bisected with a line extending through the center of the base and parallel to a line connecting the air-communication openings so as to define first and second half sections of the base, the suction opening is disposed in the first half section and the air-communication openings are disposed in the second half section.

12. The recovering device according to claim 10, further comprising a suction unit reducing the pressure in the space in the cap via the suction opening so as to perform a suction process.

13. The recovering device according to claim 12, further comprising a liquid absorber provided in the space in the cap.

14. The recovering device according to claim 13, wherein the liquid absorber is not disposed over the air-communication openings.

* * * * *